US009506216B2

(12) United States Patent
Lewis

(10) Patent No.: US 9,506,216 B2
(45) Date of Patent: Nov. 29, 2016

(54) WATER BODY CLEANER WITH SELECTIVE SEDIMENT DREDGING HEAD

(71) Applicant: Neal R. Lewis, Orland, IN (US)

(72) Inventor: Neal R. Lewis, Orland, IN (US)

( * ) Notice: Subject to any disclaimer, the term of this patent is extended or adjusted under 35 U.S.C. 154(b) by 16 days.

(21) Appl. No.: 14/553,248

(22) Filed: Nov. 25, 2014

(65) Prior Publication Data

US 2015/0143726 A1 May 28, 2015

Related U.S. Application Data

(60) Provisional application No. 61/909,159, filed on Nov. 26, 2013.

(51) Int. Cl.

| | |
|---|---|
| ***E02F 3/88*** | (2006.01) |
| ***E02F 3/92*** | (2006.01) |
| ***E02F 5/28*** | (2006.01) |
| ***E02F 3/90*** | (2006.01) |

(52) U.S. Cl.

CPC ..... *E02F 3/9243* (2013.01); *E02F 3/902* (2013.01); *E02F 3/9293* (2013.01); *E02F 5/28* (2013.01)

(58) Field of Classification Search

CPC ..... E02F 3/905; E02F 3/907; E02F 3/9243; E02F 3/8891; E02F 3/9281; E02F 3/925; E02F 3/9262; E02F 5/006; E02F 7/005; E02F 9/9293; E02F 9/902; E02F 5/28; E02F 3/88

USPC ..... 37/311, 317, 318, 320–326; 114/296; 405/228

See application file for complete search history.

(56) References Cited

U.S. PATENT DOCUMENTS

| | | | | |
|---|---|---|---|---|
| 4,018,483 | A * | 4/1977 | Smith | A47L 9/08 15/405 |
| 4,352,251 | A * | 10/1982 | Sloan | B63C 11/52 285/33 |
| 4,807,373 | A * | 2/1989 | Sloan | E02F 3/88 210/170.04 |
| 4,957,622 | A * | 9/1990 | Mims | B01D 21/245 210/170.04 |
| 5,421,105 | A * | 6/1995 | Schulte | E02F 3/963 37/309 |
| 5,970,635 | A * | 10/1999 | Wilmoth | E02B 3/023 37/323 |
| 6,209,965 | B1 * | 4/2001 | Borns | E02F 3/925 299/17 |
| 7,089,693 | B2 * | 8/2006 | Collins | E02F 3/902 37/309 |
| 7,334,358 | B1 * | 2/2008 | Whyte | E02F 3/8891 37/320 |
| 7,513,008 | B2 | 4/2009 | Tucker | |
| 7,721,472 | B2 * | 5/2010 | Buhr | E02F 3/9212 37/308 |
| 2012/0024322 | A1 | 2/2012 | Tucker | |

* cited by examiner

*Primary Examiner* — Robert Pezzuto
(74) *Attorney, Agent, or Firm* — Taylor IP, P.C.

(57) ABSTRACT

A method and apparatus for selectively removing fine sediments from a water body bottom using a dredging head with one or more intake openings situated to accelerate flows through the interior of the head and across the water body bottom causing fine particles to become suspended in a slurry outflowing from the head for disposal, while coarser, heavier, bottom gravels remain in place. The stream cleaner dredging head includes a main body having at least one intake, at least one plate attachment feature, a discharge point, and an at least partly open bottom; a flow-adjusting plate that is adjustably connected to the at least one plate attachment feature and configured to adjust a fluid flow through the main body from the at least one intake, and a hose attachment connected to the discharge point of the main body.

20 Claims, 7 Drawing Sheets

WATER BODY CLEANER WITH SELECTIVE SEDIMENT DREDGING HEAD

CROSS REFERENCE TO RELATED APPLICATIONS

This is a non-provisional application based upon U.S. provisional patent application Ser. No. 61/909,159, entitled "STREAM CLEANER WITH SELECTIVE SEDIMENT DREDGING HEAD," filed Nov. 26, 2013, which is incorporated herein by reference.

BACKGROUND OF THE INVENTION

1. Field of the Invention

The present invention relates to a water body cleaner, and, more particularly, to a water body cleaner with a sediment dredging head.

2. Description of the Related Art

Sedimentation of streams and lakes is listed by EPA as one of the most damaging pollutants of US waterways. Sedimentation chokes otherwise native coarse gravel bottoms such that the streams are no longer supportive of a diversity of native aquatic species, while also diminishing habitat for fisheries. The polluting fine sediments have entered our streams and lakes from a combination of unnatural sources, including poor agricultural practices causing wide spread soil erosion and run off, run off from streets and man-made surfaces, run off from disturbed construction sites, run off from increased deforestation, and run off from both urban and rural roads and highways.

In the last few decades, much experimentation and efforts have been made to restore streams by removing the undesirable fine sediments and restoring a relatively clean coarse gravel and cobble stream bed.

One such device is commercially sold by Streamside Systems, LLC as the Sand Wand™, which uses the unnatural method of a jetting system that drives water into the bottom and disrupts the structure to dislodge sediments into a slurry, which is then removed with a separate suctioning system. The Sand Wand is a dual system, which requires two separate heads, two sets of hose lines and two separate pumping systems. The Sand Wand's methodology is also disruptive to the stream bed, and relatively cumbersome to operate.

Shear stress is the ability of liquid flows to entrain (suspend) sediments and transport that mixed flow of liquid and sediment (slurry). Sediment particles in the streambed become suspended into the flows when the resistance to shear is exceeded, or what is known as the critical shear stress. The greater the shear stress the greater the particle that can be transported. Shear stress in a natural stream is affected by many factors, including, change in elevation, configuration of the channel, volume of flows, and size of sediments within the stream bed. Where shear stress increases, the capacity to mobilize and transport sediment increases in both volume and particle size. Where shear stress decreases the capacity to mobilize and transport sediment decreases in both volume and particle size.

Unfortunately, many US streams have been overwhelmed with fine sediment pollution to the point that those steams no longer have the capacity to create critical shear stress forces sufficient to mobilize and remove sediment pollution, leaving the stream habitats permanently degraded and without the necessary coarse gravel and cobble bottom conditions needed to support a healthy stream ecology.

What is needed in the art is a simpler system for removing undesirable sediment from a stream or other water body with less disruption to the stream or water body's bottom conditions.

SUMMARY OF THE INVENTION

The present invention provides a dredging head for selectively removing fine sediments from a stream, lake, or other water body's bottom that mimics the natural removal of sediments from a stream.

The invention in one form is directed to a dredging head that includes a main body having at least one intake, at least one plate attachment feature, a discharge point, and an at least partly open bottom; a flow-adjusting plate that is adjustably connected to the at least one plate attachment feature and configured to adjust a fluid flow through the main body from the at least one intake, and a hose attachment connected to the discharge point of the main body. The flow -adjusting plate can be readily adjusted to change the flow characteristics of fluid that enters an intake by changing the geometry of the intake or incorporating a baffle with the flow-adjusting plate that can alter the fluid flow. The one or more plate attachment features can allow for attachment of the flow-adjusting plate to the main body and can be configured to change the coverage of the intake by the flow-adjusting plate. The hose attachment connects to the discharge point of the main body and allows for outflow of a sediment slurry that is produced during the dredging head's operation. In one possible embodiment, the geometry of the main body can be altered to form a sloped front surface where the one or more intakes are located. The dredging head is configured so that the flow of fluid through the one or more intakes, through the main body, and out the discharge point can be powered by a standard trash pump. The dredging head can be configured to operate at either a hand held or construction equipment size. When the dredging head is configured to be hand held, a handle can be installed on the main body.

An advantage of the present invention is the ability to mimic a flowing river's natural ability to suspend and mobilize sediments during increased flow velocities. The higher the velocity of the flow through the dredging head, the greater its ability to suspend materials within those flows. By mimicking the natural phenomenon of critical shear stress, the present invention is able to remove undesirable sediments from a water body while leaving desirable coarse gravel and cobble in place and not disturbing the bottom structure.

Another advantage is the present invention requires only one pumping system, uses an open head and doesn't require a separate jet.

Yet another advantage of the present invention is that it can be used to clean up bottom oil spill contamination from water bodies without significant disturbance to the native bottom.

Yet another advantage of the present invention is that it can be used to clean contaminated sediment without significant release of contaminants during the cleaning process.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
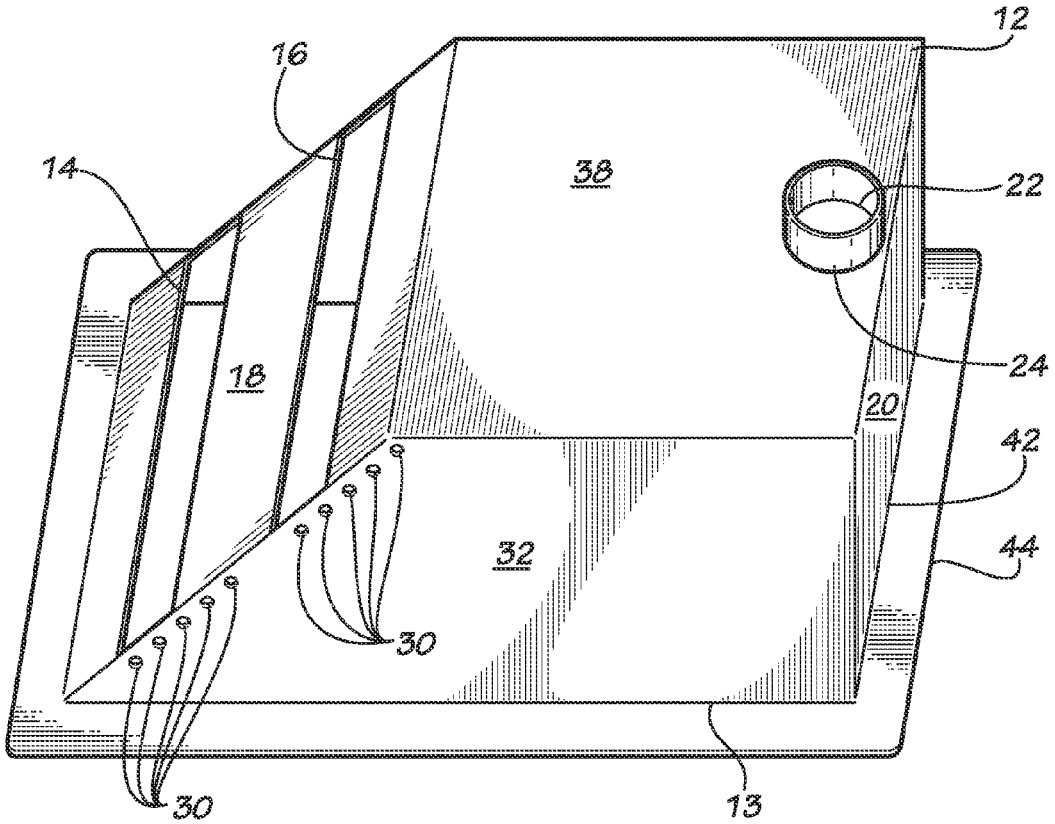
FIG. 1 is a perspective view of an embodiment of a main body of a dredging head according to the present invention.

Referring now to the drawings, and more particularly to FIG. 1, there is shown an embodiment of a dredging head 10 according to the present invention which generally includes a main body 12 having an open bottom 13 geometric shape with multiple intake openings 14, 16 in a front surface 18 of the main body 12. The intake openings 14, 16 can be slits situated in the horizontal plane of the dredging head 10. The intakes 14, 16 situated in the front surface 18 of the main body 12 accelerate flows through the head 10 and across the open bottom 13 where undesirable fine sediments from a water body bottom will be suspended into a slurry for outflow, while coarser gravel and cobble remain in place. As used herein, a "water body bottom" can refer to the bottom of a natural water body, such as a stream or lake bed, or to the bottom of a man-made water body, such as the bottom of a swimming pool. As shown, the bottom 13 is almost completely open, but the percentage of the bottom 13 that is open can be varied, as desired, to alter the sediment suspension or entrainment and removal that the dredging head 10 can perform.

The dredging head 10 is shaped with a low profile at the front associated with the intake location, which focuses the highest velocity flows in the front of the dredging head 10 across the water body bottom to entrain or suspend fine sediments within head flows. The height of the head main body 12 can increase in size from the front surface 18 to a rear surface 20 opposite the front surface 18, giving the main body 12 a sloped front surface 18, and can reduce flow velocities where a discharge point 22 of the main body 12 is located. This shaped profile of the dredging head 10 maximizes flow velocities and shear stress forces to the front for the purposes of initiating the entraining or suspension of fine sediments into a slurry, while slowing flow velocities and decreasing shear stress through the dredging head 10 rearward to the discharge point 22, which can allow desirable coarse gravel that is inadvertently dislodged to settle back to the water body bottom, while maintaining rearward velocities and shear stress forces sufficient to discharge the suspended slurry of undesirable fine sediments from the dredging head 10.

The discharge point 22 from the dredging head 10 is connected to an attachment 24 for a hose (not shown) that is in turn attached to a pump (not shown). The pump pulls flows into the head 10 through the intakes 14, 16 and pulls the slurry of sediments through the dredging head 10 into the discharge point 22. The slurry can then continue through the discharge hose, through the pump, and out of the pump to a disposal location, such as a settling pit or filtration bags.

Figure 2:
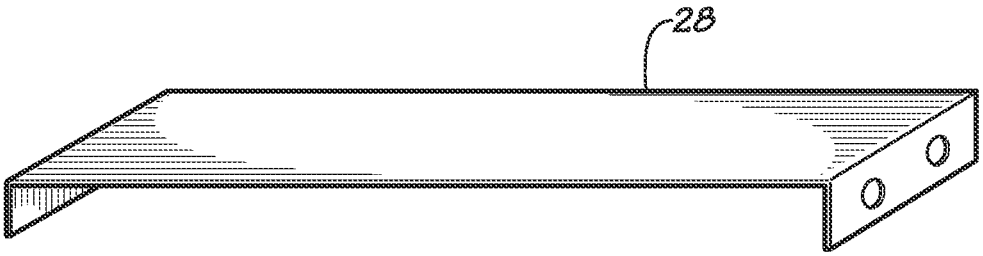
FIG. 2 is a perspective view of an embodiment of a flow-adjusting plate according to the present invention.
Figure 3:
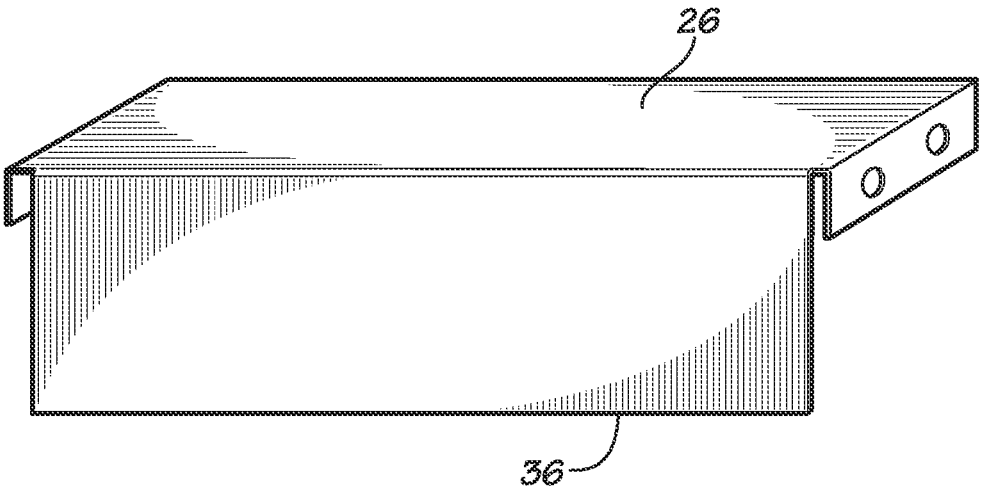
FIG. 3 is a perspective view of another embodiment of a flow-adjusting plate according to the present invention.
Figure 4:
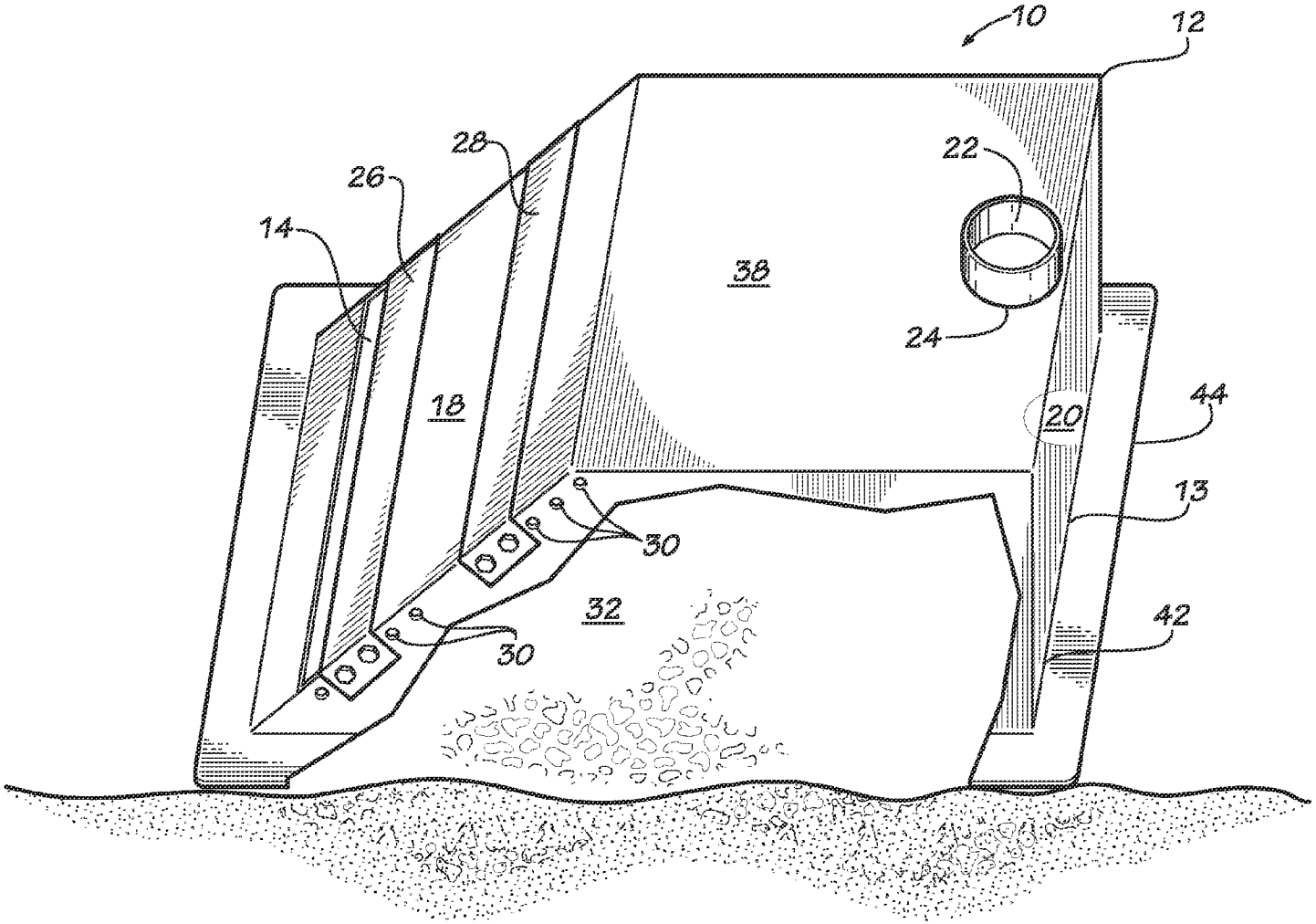
FIG. 4 is a perspective view of an embodiment of a dredging head according to the present invention that includes the main body shown in FIG. 1 with portions removed to show fine sediments being removed from a water body bottom.

As shown in FIG. 4, multiple intakes 14, 16 in the front surface 18 of the main body 12 allow for adjustment of the direction and volume of flows through the dredging head 10, and the flows through any individual intake 14 or 16 can be increased or decreased by use of flow-adjusting plates 26, 28 positioned in a full open position, relative to the intakes 14 or 16, various partially open positions and a full closed position. The flow-adjusting plates 26, 28 are adjustably connected to plate attachment features 30, shown in FIGS. 1 and 4 as openings formed in side surfaces 32 of the main body 12. The direction of flows through individual intakes 14, 16 can be adjusted through the use of flow-adjusting plate 28, shown in FIG. 2, that simply covers a portion of its respective intake, or by flow-adjusting plate 26, shown in FIG. 3, which includes an attached baffle 36 that will further direct the flow of fluid through the dredging head 10 after the fluid has entered the main body 12. Flows through the intakes 14, 16 can also be increased or decreased by adjusting the capacity of the pump.

The number of intakes open, the setting of those openings, the use of baffles, and the setting of the pump capacity all will vary dependent upon the conditions of the water body bottom. Relevant conditions include the size of undesirable sediment to be removed, size of the desired coarser materials intended to remain at the water body bottom, and the ratio of undesirable to desirable materials at any given location in the water body bottom.

Full opening of both intakes 14, 16, without the use of flow-adjusting plates 26 with baffles 36, will decrease flow velocity through the head 10 and diffuse flows across the water body bottom, thus diminishing the dredging head's 10 capacity to suspend and remove anything but the finest organic particulate from the water body bottom.

Opening only the lowest intake 14, while closing the upper intake 16, will conversely accelerate the velocity of flows entering the dredging head 10 and focus the flow along the bottom 13, thus increasing the dredging head's 10 capacity for suspending and removing sediments, both in size and volume.

Closing the bottom intake structure 14, while opening the upper intake 16, will achieve the same velocity of flows entering the dredging head 10, assuming intakes 14 and 16 are equally sized, but at a location that will diffuse the force of flows across the bottom 13, thus diminishing both the particle size and volume of sediments the dredging head 10 is capable of removing.

Adding a baffle to the flow-adjusting plates allows for directing the accelerated flows through the dredging head 10 at the closest possible distance to the bottom 13, thus increasing the focus of accelerated flows across the bottom 13, which in turn increases the size and volume of sediments the dredging head 10 is capable of removing.

As can be seen, the flow-adjusting plates 26, 28 can be adjustably connected to the plate attachment features 30 so that the free flow area of one or more of the intakes 14, 16 can be changed. As used herein, "free flow area" refers to the portion of the intakes 14, 16 that are uncovered and will allow fluid flow to enter the main body 12 of the dredging head 10 through the intakes 14, 16. The flow-adjusting plates 26, 28 can be formed of any material and have any suitable thickness that allows for them to direct water flow into the main body 12 and produce sufficient shear stress across the water body bottom to dislodge sediments that have accumulated. The plate attachment features 30, while shown as openings, could be other types of features that allow for the flow-adjusting plates 26, 28 to be adjustably connected to the plate attachment features 30 and adjust the flow characteristics and direction of fluid through the main body 12 through one or more of the intakes 14 and 16.

As shown, the main body 12 can include, in addition to the front surface 18, rear surface 20 and side surfaces 32, a top surface 38 that is opposed to the bottom 13 to form a roughly rectangular box with a sloped front surface 18. The bottom 13 can have a greater geometric area than the top surface 38 so that the main body 12 can rest more stably on the bottom 13 than the top surface 38. As shown, the side surfaces 32 and rear surface 20 can all be generally orthogonal relative to the bottom 13 and top surface 38, with the front surface 18 extending from the bottom 13, which is longer than the top surface 38, toward the top surface 38. The surfaces of the main body 12 can also form acute angles relative to one another, if desired. A bottom perimeter 42 is defined by the bottom edges of the surfaces 18, 32, and 40 with a flange 44 extending away from the bottom perimeter 42. The flange 44 can be substantially flat or can be angled, as desired, to make it easier for the dredging head 10 to sit on a stream bed, or other water body bottom. The flange 44 can also have weights placed thereon, such as rocks of the water body, or be otherwise embedded into the water body bottom to secure the dredging head 10 to the water body bottom. The discharge point 22 is shown as being located on top surface 38, but could be placed on any of the other surfaces 18, 32 and 40, if desired, depending on the flow characteristics of fluid and sediment through the main body 12. It should be appreciated that references to the "front," "rear," "side," "top," and "bottom" of the main body 12 are for convenience of description for the dredging head's 10 various features' and surfaces' positioning relative to one another and are not intended to limit the configurations of the dredging head 10 according to the present invention.

Figure 6:
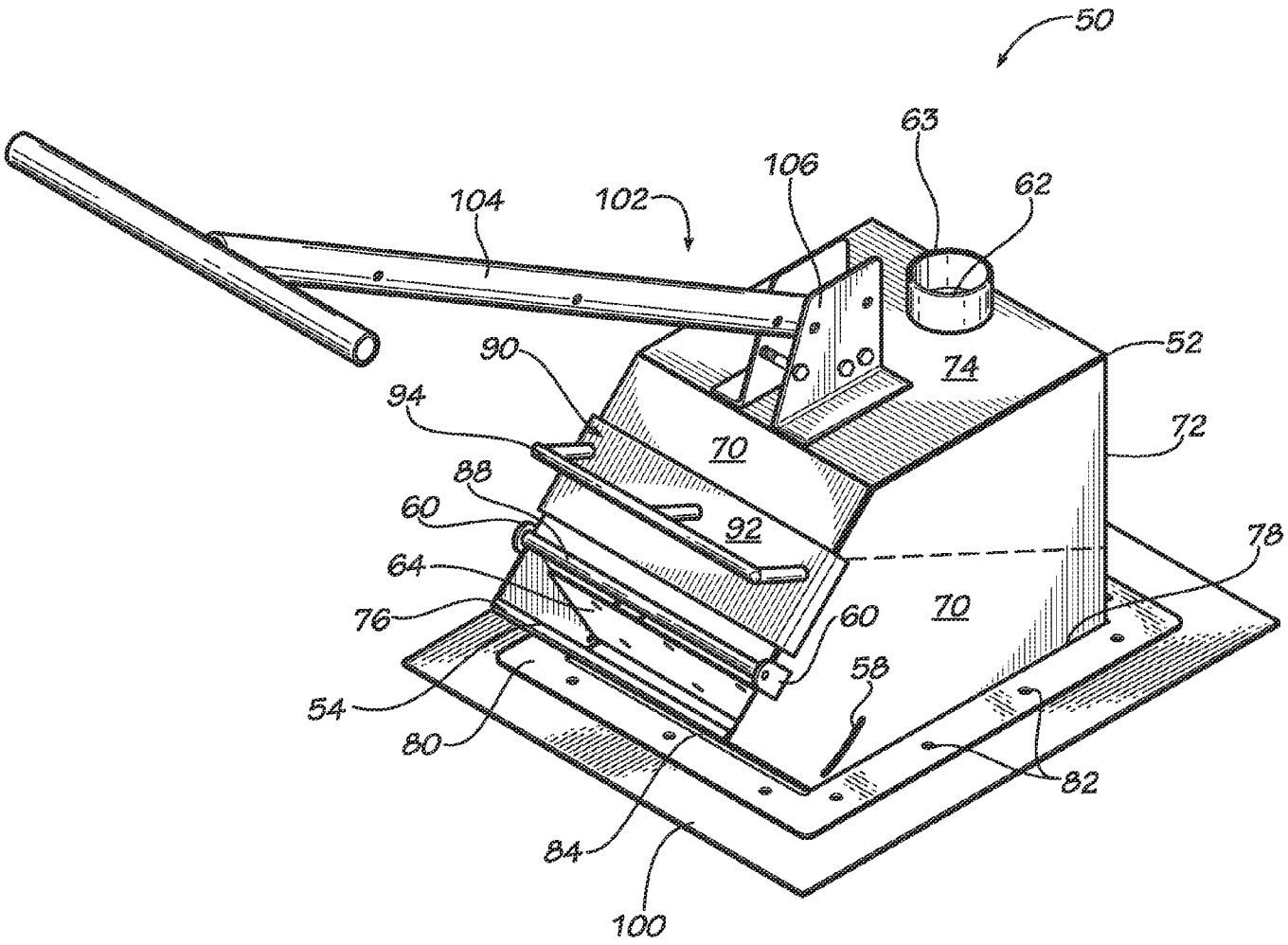
FIG. 6 is a perspective view of another embodiment of a dredging head according to the present invention that includes the main body shown in FIG. 5.
Figure 7:
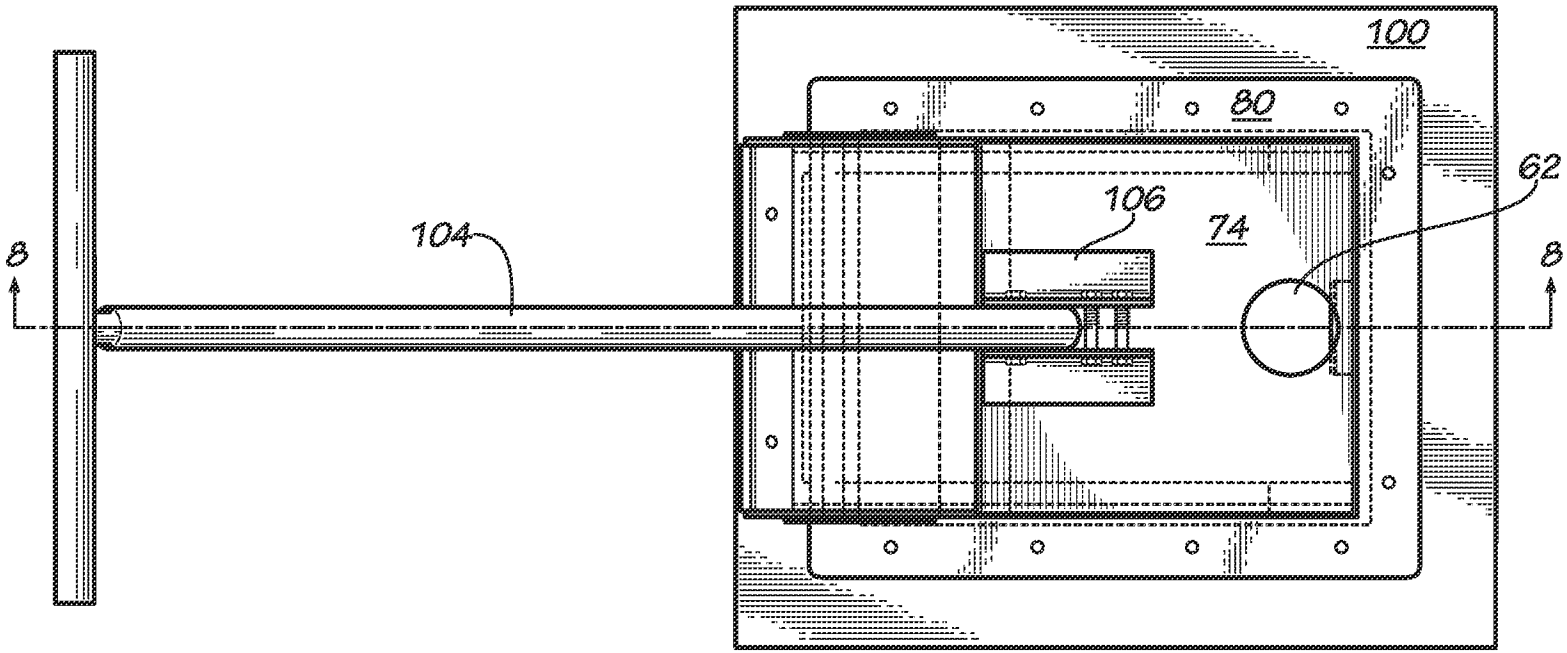
FIG. 7 is a top view of the dredging head shown in FIG. 6.
Figure 8:
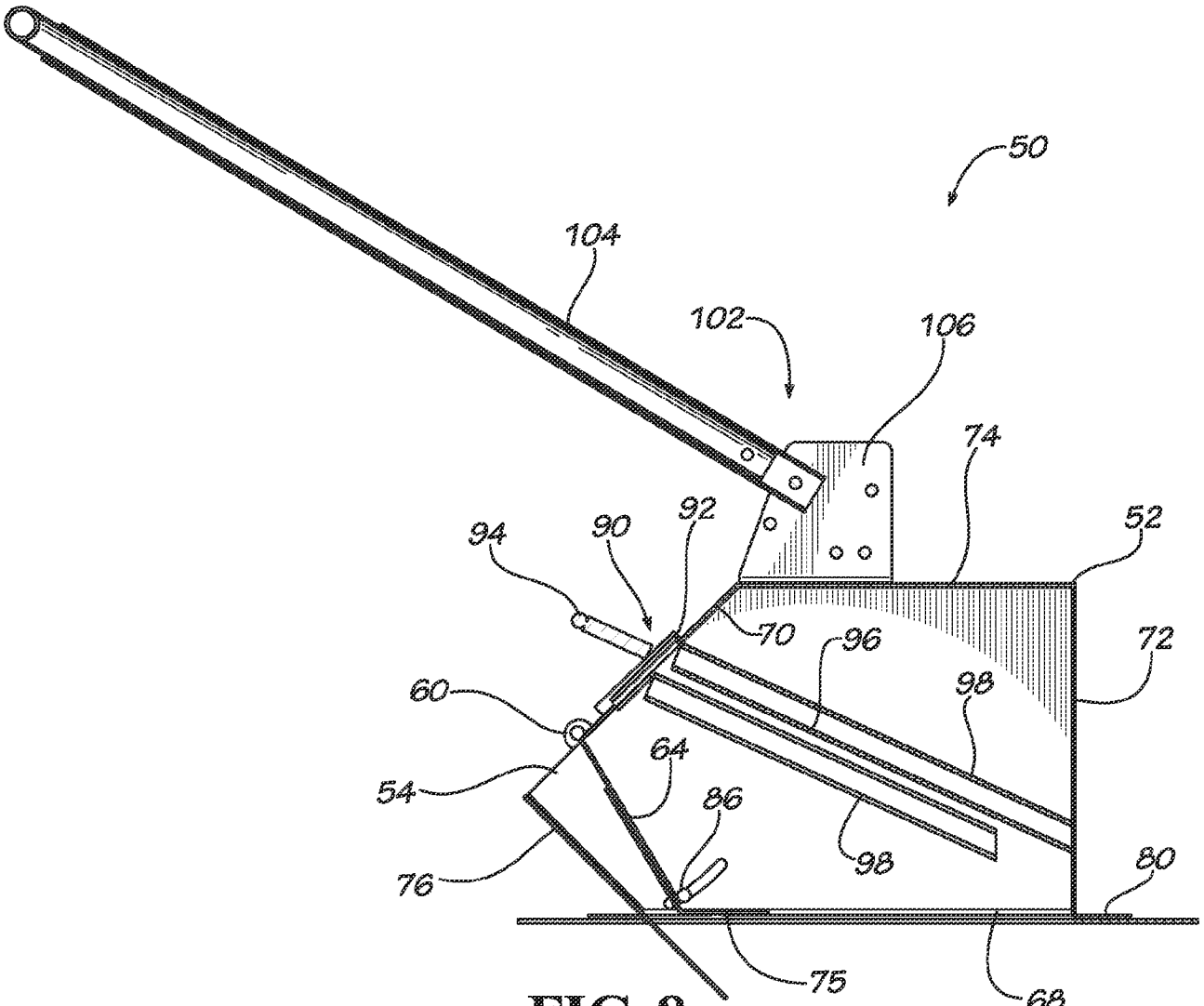
FIG. 8 is a cross-sectional view of the dredging head shown in FIG. 7 taken along line 8-8.

Referring now to FIGS. 5-8, another embodiment of a dredging head 50 according to the present invention is shown that includes a main body 52 with intakes 54 and 56, plate attachment features 58 and 60, and a discharge point 62, a flow-adjusting plate 64 adjustably connected to the plate attachment features 58 and 60, and a hose attachment 63 that is connected to the discharge point 62 of the main body 52. As can be seen, the main body 52 has a similar shape to the main body 12 shown in FIGS. 1-4, with a front surface 66, an open bottom 68, a pair of side surfaces 70, a rear surface 72 opposed to the front surface 66, and a top surface 74 opposed to the bottom 68. The front surface 66 is sloped in a direction away from the bottom 68 toward the top surface 74. The front surface 66 can connect to a cutter plate 76 that is sloped oppositely to the front surface 66, i.e., toward the bottom 68. As shown in FIG. 8, the cutter plate 76 can extend from the front surface 66 to the bottom 68, to create a roughly 90 degree angle with the front surface 66. A bottom perimeter 78 can be defined at the bottoms of the side surfaces 70, rear surface 72, and cutter plate 76 around the main body 52, with a flange 80 extending away from the bottom perimeter 78. The flange 80 can have one or more anchoring openings 82 that can have anchoring pins (not shown) pushed through to help anchor the dredging head 50 within a water body bottom. An additional intake 84 can be formed between the cutter plate 76 and the flange 80, which will allow more fluid to flow through the water body bottom to loosen sediment from the water body bottom that can then be forced out of the discharge point 62.

Figure 5:
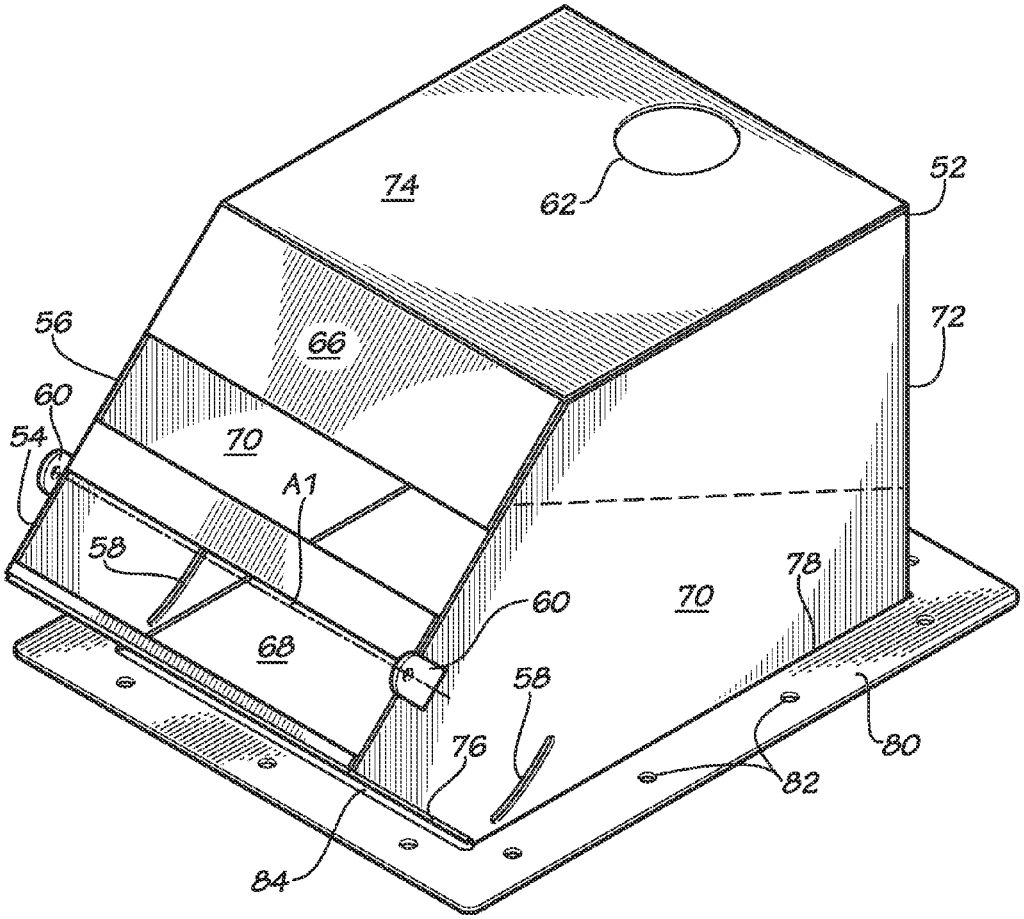
FIG. 5 is a perspective view of another embodiment of a main body of a dredging head according to the present invention.

As can be seen, the plate attachment features 58, most clearly shown in FIG. 5, are arced slots that are formed in the side surfaces 70 of the main body 52 and the plate attachment features 60 are blade supports with openings that define an axis of rotation Al therebetween for the flow-adjusting plate 64 when it is secured to the blade supports 60. Pins 86, shown in FIGS. 6 and 8, on the flow-adjusting plate 64 can be placed in the arced slots 58 so that the angle formed between the flow-adjusting plate 64 and the front surface 66 can be adjusted by sliding the pins 86 through the arced slots 58 and rotating a plate handle 88 of the flow-adjusting plate 64 about the axis of rotation A1. Once the flow-adjusting plate 64 creates a desired angle with the front surface 66, the pins 86 can be anchored in position to prevent the flow-adjusting plate 64 from easily being moved into a different orientation during operation. One way of anchoring the pins 86 in position to resist movement of the flow-adjusting plate 64 is to tighten the pins 86 to the side surfaces 70 using a fastener (not shown), such as a nut. It should be appreciated that the pins 86 can be anchored in any reversible manner that allows the angle formed between the flow -adjusting plate 64 and front surface 66 to be adjustable. It should be further appreciated that the arced slots 58 and blade supports 60 could be replaced with different plate attachment features, such as the openings 30 shown in FIGS. 1 and 4, that allow for the flow-adjusting plate 64 to be adjustably connected. By adjustably connecting the flow-adjusting plate 64 to the attachment features 58 and 60, the angle formed between the flow-adjusting plate 64 and front surface 66 can be adjusted, as desired, to achieve various fluid flow velocities through the intake 54 and across the bottom 68 of the dredging head 50. For example, the pins 86 can be anchored to an end of the arced slots 58 closest to the front surface 66 to create a small angle between the flow-adjusting plate 64 and front surface 66 that can create a high flow velocity of fluid through the intake 54 to travel toward the bottom 68 of the dredging head 50. Similarly, anchoring the pins 86 to an end of the arced slots 58 closest to the rear surface 72 creates a large angle between the flow-adjusting plate 64 and front surface 66 that can create a low velocity of fluid through the intake 54 to travel toward the bottom 68 of the dredging head 50. The pins 86 can also be anchored between the ends of the arced slots 58 to form various angles between the flow-adjusting plate 64 and front surface 66 that give other flow velocities of fluid through the intake 54. The flow-adjusting plate 64 can therefore re-direct flow into the main body 52 in various ways to create the critical shear stress necessary to remove fine sediments from the bottom of a water body covered by the dredging head 50. If desired, a baffle 65 can be attached to the flow -adjusting plate 64, as shown, similar to flow-adjusting plate 26 with baffle 36 previously described and shown in FIGS. 3 and 4. As can be seen, the baffle 65 can be attached to the flow -adjusting plate 64 to further direct the flow of fluid through the intake 54 and across the bottom 68 of the dredging head 50, which will sweep across the water body bottom to entrap fine sediment from the water body bottom to be removed through the discharge point 62. As shown, the baffle 65 can be attached to the flow-adjusting plate 64 so that the baffle 65 will extend along a plane that is generally parallel to the bottom 68 of the dredging head 50, but other relative orientations between the flow-adjusting plate 64 and baffle 65 can also be chosen as desired.

Referring now to FIGS. 6-8, it can be seen that intake 56 can be covered with a removable filter 90 that has a filter plate 92, a filter handle 94 connected to the filter plate 92, and a filter screen 96. The filter plate 92 can entirely cover the intake 56, as shown, or can cover only a portion of the intake 56 to allow fluid to flow into the main body 52 through the intake 56. The filter plate 92 can be secured to the main body 52, if desired, to make removal of the filter 90 more difficult or make the filter 90 non-removable. As shown in FIG. 8, the filter screen 96 can be held in a pair of filter slides 98 that are connected to the main body 52. The filter slides 98 allow for easy orientation of the filter screen 96 within the main body 52 and also provide some support for the filter screen 96 during operation. If filter slides 98 are included, the filter 90 can be removed from and placed into the dredging head 50 by sliding the filter screen 96 along the filter slides 98 using the filter handle 94. The filter slides 98 can be attached to the main body 52 so that they do not extend entirely to the rear surface 72, to lessen the risk that gravel and debris loosened by the dredging head 50 block the filter slides 98 and make sliding of the filter screen 96 across the filter slides 98 difficult. The filter screen 96 can have apertures (not shown) that are sized to allow a certain size of fine sediment to pass through the filter screen 96 from the bottom 68 of the dredging head 50 toward the discharge point 62 on the top surface 74, while preventing coarse gravel and cobble from passing through the filter screen 96 and being undesirably removed from the water body bottom. The filter screen 96 can therefore allow for high flow velocities to be created in the dredging head 50 without removing the desirable coarse gravel and cobble from the water body bottom, which can increase the fine sediment removal amount and rate.

The flange 80 of the dredging head 50 can have a flexible material 100, shown as a rubber gasket, surrounding the flange 80. The rubber gasket 100 can surround the entirety of the flange 80, as shown, or could surround only a portion of the flange 80 if desired. The rubber gasket 100 can surround the flange 80 in a variety of ways, such as by connection to the flange 80 or having a compartment formed in the rubber gasket 100 that the flange 80 slides into and rests within. The rubber gasket 100 can be included to account for the variety and heterogeneity of water body bottoms that the dredging head 50 encounters when removing sediment. A water body bottom tends to be an uneven surface, due to the presence of differently sized and shaped objects like rocks, plant matter, debris, etc., that makes creating a seal between the dredging head 50 and water body bottom difficult. Without a seal formed between the dredging head 50 and the water body bottom, the fluid flow that is directed into the dredging head 50 tends not to entrap or entrain fine sediment as efficiently as when a seal is created between the dredging head 50 and the water body bottom, due to pressure leakage out of the main body 52. The rubber gasket 100 can be pulled toward the water body bottom due to suction that is created within the dredging head 50 by a pump (not shown) connected to the hose attachment 63, creating a seal around objects on the water body bottom that make the water body bottom an uneven surface. In this respect, the rubber gasket 100 can help create a seal between the dredging head 50 and water body bottom to increase the efficiency of fine sediment removal by the dredging head 50.

The dredging head 50 can further include a handle 102 connected to the main body 52 that includes a handling portion 104 and a connector 106 that connects the handle 102 to the main body 52. As shown, the handle 102 is connected to the top surface 74 of the main body 52 by the connector 106, but the handle 102 could be connected to any surface of the main body 52. The handle 102 can allow for the dredging head 50 to be pulled or pushed across a water body bottom or other surface. The handling portion 104 can be adjustably connected to the connector 106 such that the angle that the handling portion 104 forms relative to the surface of the main body 52 that the connector 106 is attached to can be adjusted. The length of the handling portion 104 can also be adjusted to account for various ways that the dredging head 50 is to be pulled or pushed across the water body bottom. As shown, the handling portion 104 is adapted to be pulled by a living creature, such as a human, but could also be adapted to be pulled by a water vessel, such as a boat, or other moving object that can provide a force to push or pull the dredging head 50 along the water body bottom.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A dredging head for removing sediment from a water body, comprising:

a main body having at least one intake, at least one plate attachment feature, a discharge point, and an at least partly open bottom, said main body defining an interior volume;

a flow-adjusting plate adjustably connected to said at least one plate attachment feature and extending into said interior volume of said main body toward said at least partly open bottom, said flow-adjusting plate being configured to adjust a fluid flow from said at least one intake through said at least partly open bottom; and a hose attachment connected to said discharge point of said main body.

2. The dredging head of claim 1, wherein said at least one intake is configured such that a critical shear force is created within said dredging head of sufficient velocity to entrain fine sediments within said dredging head as a fluid flows through said at least one intake, while the critical shear force is moderated at said discharge point such that any desirable heavy gravel and cobble do not exit said dredging head.

3. The dredging head of claim 1, wherein said main body includes a front surface where said at least one intake is located, a rear surface opposed to said front surface, a top surface opposed to said at least partly open bottom, and at least one side surface.

4. The dredging head of claim 3, wherein at least one of said front surface, said top surface, said at least one side surface, and said rear surface includes at least one additional intake.

5. The dredging head of claim 4, wherein said at least one additional intake extends from said front surface and around to said at least one side surface.

6. The dredging head of claim 3, further comprising at least one additional intake located on any of said surfaces of said main body except for said front surface.

7. The dredging head of claim 3, wherein said at least one plate attachment feature is at least one of a blade support attached to said front surface and an arced slot formed in said side surface.

8. The dredging head of claim 3, wherein said front surface is sloped relative to said top surface.

9. The dredging head of claim 8, wherein said rear surface is generally orthogonal relative to said top surface.

10. The dredging head of claim 8, wherein said front surface is sloped from said at least partly open bottom of said main body toward said top surface in a direction toward said rear surface.

11. The dredging head of claim 10, further comprising a cutter plate attached to said front surface and extending toward said at least partly open bottom.

12. The dredging head of claim 3, wherein said at least one plate attachment feature is formed on said at least one side surface.

13. The dredging head of claim 3, wherein said at least one flow-adjusting plate includes a baffle.

14. The dredging head of claim 3, further comprising a flange attached to a bottom perimeter of said main body.

15. The dredging head of claim 14, further comprising a flexible material at least partially surrounding said flange.

16. The dredging head of claim 1, wherein said dredging head has one intake.

17. The dredging head of claim 1, further comprising a filter held within said main body between said at least partly open bottom and said discharge point.

18. The dredging head of claim 17, wherein said filter is removable from said main body.

19. A dredging head for removing sediment from a water body, comprising:

a main body having at least one intake, at least one plate attachment feature, a discharge point, and an at least partly open bottom, said main body defining an interior volume;

a flow-adjusting plate having a first end adjustably connected to said at least one plate attachment feature and a second end opposite said first end extending into said interior volume of said main body toward said at least partly open bottom, said flow-adjusting plate being configured to adjust a fluid flow through said main body from said at least one intake; and a hose attachment connected to said discharge point of said main body.

20. A dredging head for removing sediment from a water body, comprising:

a main body having at least one intake, at least one plate attachment feature, a discharge point, and an at least partly open bottom, said main body defining an interior volume;

a flow-adjusting plate rotatably connected to said at least one plate attachment feature and extending into said interior volume of said main body toward said at least partly open bottom, said flow-adjusting plate being configured to adjust a fluid flow through said main body from said at least one intake, said at least one plate attachment feature defining an axis of rotation of said flow-adjusting plate which does not extend through a center of said flow-adjusting plate; and a hose attachment connected to said discharge point of said main body.

* * * * *